US012345491B2

(12) United States Patent
Dueck et al.

(10) Patent No.: US 12,345,491 B2
(45) Date of Patent: Jul. 1, 2025

(54) DIVERGING CENTRAL BORE FOR FIREARM SOUND SUPPRESSOR

(71) Applicant: SureFire, LLC, Fountain Valley, CA (US)

(72) Inventors: Barry William Dueck, Fountain Valley, CA (US); Michael Scott Standen, Fountain Valley, CA (US); Eric Hung Leung Chow, Fountain Valley, CA (US); Ryan Steven Glasby, Fountain Valley, CA (US); Doug Lawrence Stefanski, Fountain valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 17/990,593

(22) Filed: Nov. 18, 2022

(65) Prior Publication Data

US 2023/0288162 A1 Sep. 14, 2023

Related U.S. Application Data

(63) Continuation-in-part of application No. 17/882,430, filed on Aug. 5, 2022.

(60) Provisional application No. 63/230,515, filed on Aug. 6, 2021.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/04
See application file for complete search history.

(56) References Cited

U.S. PATENT DOCUMENTS 1,017,003 A * 2/1912 Kenney ..... F41A 21/30 89/14.4
1,066,898 A * 7/1913 Gray ..... F41A 21/30 181/223
4,341,283 A * 7/1982 Mazzanti ..... F41A 21/30 181/275
4,576,083 A * 3/1986 Seberger, Jr. ..... F01N 1/08 89/14.4

(Continued)

*Primary Examiner* — Derrick R Morgan
(74) *Attorney, Agent, or Firm* — Rutan & Tucker LLP; Hani Z. Sayed

(57) ABSTRACT

An apparatus and methods are provided for a front plate having a diverging central bore for firearm sound suppressors that improves noise and flash characteristics during firing a weapon. The central bore is disposed between a back surface and a front surface of the front plate. An untapered portion of the central bore extends from the back surface to a diverging portion that opens toward the front surface. The diverging portion includes a curvature profile configured to allow for more controlled expansion of high-pressure propellant gases exiting of the suppressor through the central bore. The curvature profile provides an included angle of the central bore that decreases secondary flash events accompanying the expulsion of propellant gases accompanying a fired bullet exiting the suppressor through the central bore. The curvature profile exhibits a cross-sectional area of the central bore that is proportional to a distance along the diverging portion.

7 Claims, 6 Drawing Sheets

(56) References Cited

U.S. PATENT DOCUMENTS 4,583,445 A * 4/1986 Blair ..... F41A 21/34 89/14.3
4,893,544 A * 1/1990 Hawley ..... F41A 21/34 89/14.2
5,092,223 A * 3/1992 Hudson ..... F41A 21/34 89/14.3
5,325,759 A * 7/1994 Warner ..... F41A 21/34 89/14.3
6,308,608 B1 * 10/2001 Eisenman ..... F41A 21/32 89/14.3
8,167,084 B1 * 5/2012 Moore ..... F41A 21/30 181/223
8,459,405 B1 * 6/2013 Dueck ..... F41A 21/34 89/14.4
8,505,680 B2 * 8/2013 Dueck ..... F41A 21/34 89/14.4
8,584,794 B2 * 11/2013 Dueck ..... F41A 21/30 89/14.4
8,939,057 B1 * 1/2015 Edsall ..... F41A 21/30 89/14.05
8,967,325 B1 * 3/2015 Cronhelm ..... F41A 21/30 89/14.4
9,347,727 B1 * 5/2016 Cler ..... F41A 21/30
9,658,010 B1 * 5/2017 Oglesby ..... F41C 23/16
10,502,513 B2 * 12/2019 Ellison ..... F41A 21/30
10,634,445 B1 * 4/2020 Klett ..... F41A 21/30
11,268,777 B1 * 3/2022 Grant ..... F41A 21/34
11,680,764 B1 * 6/2023 Bray ..... F41A 21/32 181/223
2010/0163336 A1 * 7/2010 Presz, Jr. ..... F41A 13/08 181/223
2011/0271575 A1 * 11/2011 Overbeek Bloem ... F41A 21/34 42/90
2013/0180796 A1 * 7/2013 Dueck ..... F41A 21/325 29/428
2014/0190345 A1 * 7/2014 Daniel ..... F41A 21/325 89/193
2014/0231168 A1 * 8/2014 Dueck ..... F41A 21/325 181/223
2016/0076844 A1 * 3/2016 Miller, III ..... F41A 21/30 89/14.3
2016/0209152 A1 * 7/2016 Dueck ..... F41A 21/30
2016/0223281 A1 * 8/2016 Randall ..... F41A 21/36
2017/0030672 A1 * 2/2017 Larue ..... F41A 21/325
2018/0202742 A1 * 7/2018 Brittingham ..... F41A 21/34
2018/0266783 A1 * 9/2018 Morreau ..... F41A 21/34
2019/0257607 A1 * 8/2019 Dobrinescu ..... F41A 21/30
2020/0025494 A1 * 1/2020 Parker ..... F41A 21/30
2020/0109907 A1 * 4/2020 Klett ..... F41A 21/30
2020/0182579 A1 * 6/2020 Llewellyn ..... F41A 21/26
2020/0248980 A1 * 8/2020 Bragais ..... F41A 21/32
2021/0003360 A1 * 1/2021 Kras ..... F41A 21/30
2021/0041200 A1 * 2/2021 Kras ..... F41A 21/30
2021/0172694 A1 * 6/2021 Reel ..... F41A 21/32
2021/0190451 A1 * 6/2021 Miller ..... F41A 21/34
2021/0254920 A1 * 8/2021 Miller ..... F41A 21/30
2022/0049920 A1 * 2/2022 Kras ..... F41A 21/30
2022/0276016 A1 * 9/2022 Dueck ..... F41A 21/34
2023/0175802 A1 * 6/2023 Bundy ..... F41A 21/325 89/14.4
2023/0221088 A1 * 7/2023 Olsen ..... F41A 21/30 89/14.4

* cited by examiner

FIG. 3
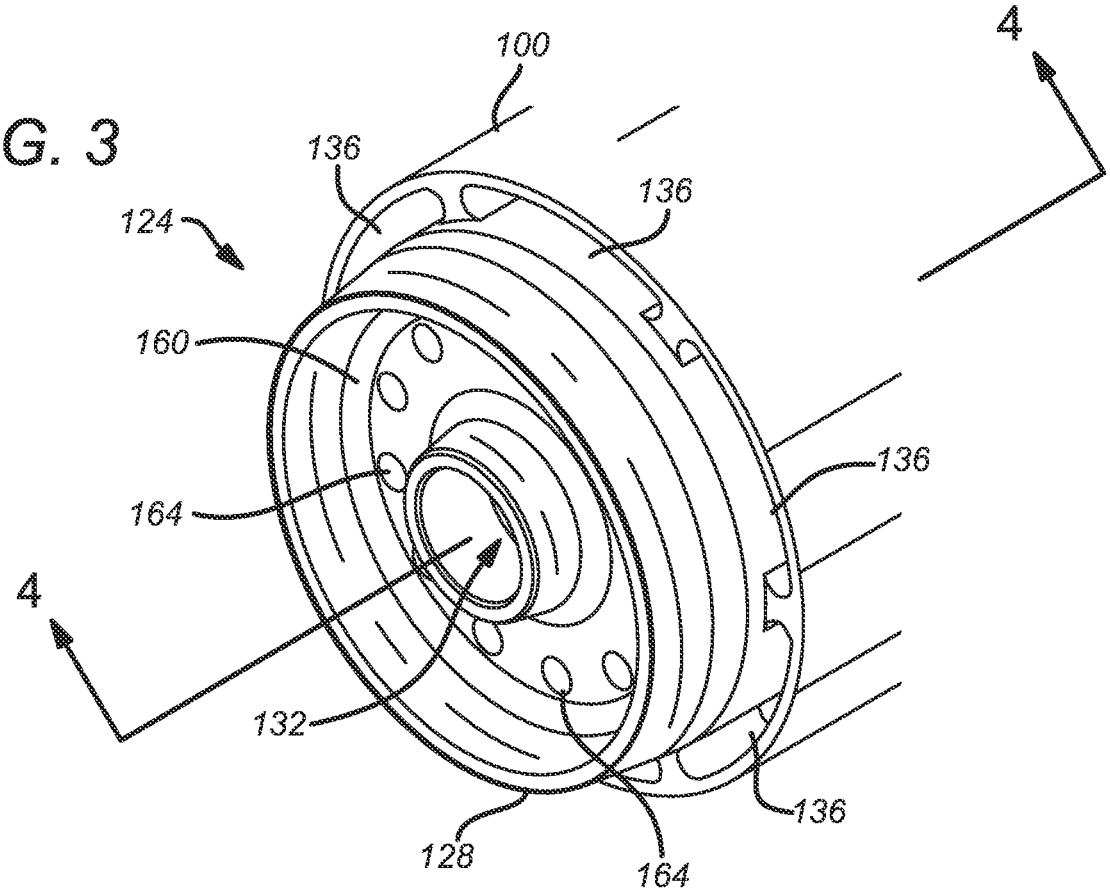
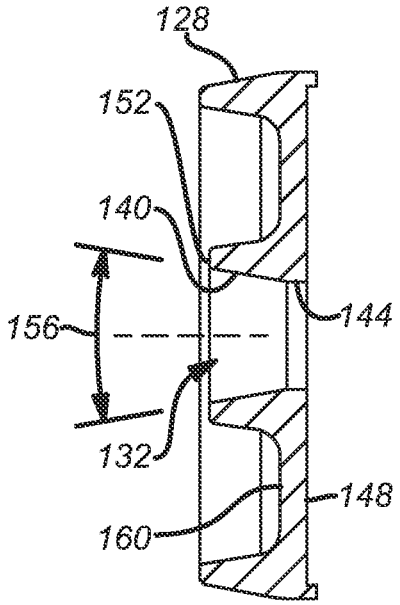
FIG. 4

FIG. 8A

268

264

260

272

280

276

| | | |
|---|---|---|
| DIVERGING LENGTH | 0.32 | Area |
| Post Edm Bore | 0.28 | 0.061575 |
| 1/10\|.032\| Bore | 0.2936086 | 0.067704 |
| Slope Area Curve | \| .077442- .061575\|/.082 | 0.191516 |
| Sq: Area - | .061575+\|.191516*X\| | |
| | | |
| Distance | Area | Diameter |
| 0 | 0.0616 | 0.28 |
| 0.032 | 0.0677 | 0.296604 |
| 0.064 | 0.0738 | 0.306604 |
| 0.096 | 0.0800 | 0.319076 |
| 0.128 | 0.0861 | 0.331077 |
| 0.16 | 0.0922 | 0.342669 |
| 0.192 | 0.0983 | 0.353862 |
| 0.224 | 0.1045 | 0.364721 |
| 0.256 | 0.1106 | 0.375266 |
| 0.288 | 0.1167 | 0.385523 |
| 0.32 | 0.1229 | 0.395513 |

FIG. 8B

268

264

260

272

280

276

| | | |
|---|---|---|
| DIVERGING LENGTH | 0.32 | Area |
| Post Edm Bore | 0.28 | 0.061575 |
| 1/4 \|.080\| Bore | 0.31400906 | 0.077442 |
| Slope Area Curve | \| .077442- .061575\|/.080 | 0.19833 |
| Sq: Area - | .061575+\|.19833*X\| | |
| | | |
| Distance | Area | Diameter |
| 0 | 0.0616 | 0.28 |
| 0.082 | 0.0679 | 0.294076 |
| 0.064 | 0.0743 | 0.307508 |
| 0.096 | 0.0806 | 0.320878 |
| 0.128 | 0.0870 | 0.33275 |
| 0.16 | 0.0933 | 0.344679 |
| 0.192 | 0.0997 | 0.356208 |
| 0.224 | 0.1060 | 0.367375 |
| 0.256 | 0.1123 | 0.378213 |
| 0.288 | 0.1187 | 0.388749 |
| 0.32 | 0.1250 | 0.399007 |

FIG. 8C

268

264

260

272

280

276

| | | |
|---|---|---|
| DIVERGING LENGTH | 0.32 | Area |
| Post Edm Bore | 0.28 | 0.061575 |
| 9/10\|.288\| Bore | 0.4024326 | 0.127197 |
| Slope Area Curve | \| .127197- .061575\|/.288 | 0.227853 |
| Sq: Area - | .061575+\|.227853*X\| | |
| | | |
| Distance | Area | Diameter |
| 0 | 0.0616 | 0.28 |
| 0.062 | 0.0689 | 0.296114 |
| 0.064 | 0.0762 | 0.311395 |
| 0.096 | 0.0834 | 0.325961 |
| 0.128 | 0.0807 | 0.339903 |
| 0.16 | 0.0980 | 0.353296 |
| 0.192 | 0.1053 | 0.366198 |
| 0.224 | 0.1126 | 0.378662 |
| 0.256 | 0.1199 | 0.390728 |
| 0.288 | 0.1272 | 0.402433 |
| 0.32 | 0.1345 | 0.413806 |

DIVERGING CENTRAL BORE FOR FIREARM SOUND SUPPRESSOR

PRIORITY

This application is a continuation-in-part of, and claims the benefit of, U.S. patent application, entitled "Firearm Sound Suppressor With Peripheral Venting," filed on Aug. 5, 2022, and having application Ser. No. 17/882,430, which claims the benefit of, and priority to, U.S. Provisional Application, filed on Aug. 6, 2021, and having application Ser. No. 63/230,515, the entirety of each of said applications being incorporated herein by reference.

FIELD

Embodiments of the present disclosure generally relate to firearms. More specifically, embodiments of the disclosure relate to an apparatus and methods for a diverging central bore for firearm sound suppressors that improves noise and flash characteristics during firing a weapon.

BACKGROUND

Firearms, such as pistols and rifles, generally utilize expanding high-pressure gases generated by a burning propellant to expel a projectile from the weapon at a relatively high velocity. When the projectile, or bullet, exits a muzzle end of the weapon's barrel, a bright, "muzzle flash" of light and a high-pressure pulse of combustion gases accompany the bullet. The rapid pressurization and subsequent depressurization caused by the high-pressure pulse gives rise to a loud sound known as "muzzle blast," which, like muzzle flash, can readily indicate to a remote enemy both the location of the weapon and the direction from which it is being fired. In some situations, such as covert military operations, it is highly desirable to conceal this information from the enemy by suppressing the muzzle flash and/or substantially reducing the amplitude of the muzzle blast.

The muzzle blasts of firearms may be reduced by using sound suppressors, such as "noise suppressors" and "silencers." Suppressors generally reduce muzzle blast by reducing and controlling the energy level of propellant gases accompanying a projectile as it exits the muzzle end of the weapon. Suppressors typically comprise an elongated tubular housing containing a series of baffles that define a plurality of successive internal chambers. The internal chambers control, delay, and divert the flow, expansion, and exit of the propellant gases. The internal chambers further serve to reduce the temperature of the propellant gases so as to cause a corresponding reduction in the noise produced by the propellant gases as they ultimately exit the suppressor. A rear portion of a typical suppressor may include a mechanism for removably attaching the suppressor to a firearm, and a front portion generally includes an opening for the exit of projectiles. Further, the front portion of suppressors typically are located sufficiently forward of the muzzle end of firearms to effectively function as a muzzle flash hider.

In some embodiments, suppressors are configured to reduce the temperature and pressure of propellant gases by introducing the gases into a succession of expansion chambers so as to give rise to a controlled expansion of the gases. In other embodiments, however, suppressors may be of a "multi-stage" variety that is configured to divert a portion of the propellant gases through a plurality of radial vents to one or more un-baffled, radially disposed "blast suppressor" chambers before being introduced into the succession of expansion chambers. Although multi-stage suppressors are relatively more complex to implement, they generally provide more opportunities to delay and cool the propellant gases, and hence, to reduce muzzle blast sound levels overall.

Existing suppressors have certain drawbacks that generally hinder their operation and/or efficiency. For example, one drawback to existing suppressors is that with extended use, particulate contaminates comprising propellant gases condense and are deposited on interior surfaces, such as the surfaces of the baffles, of the suppressors. These deposits include carbon from burnt propellant, lead from projectiles, and in the case of the use of "jacketed" projectiles, copper, Teflon, and/or molybdenum disulfide. While these deposits can usually be cleaned away with suitable solvents, they are typically hard and adhesive in nature, making it difficult or impossible to effectively clean the suppressor without damaging its parts.

A drawback to existing suppressors is that conventional sound and flash suppression generally causes higher back pressures within the suppressors. Higher back pressure is known to expose an operator of a weapon to toxic fumes arising due to firing the weapon. As such, a potential risk to the health of the operator grows in direct proportion to the amount of time spent using the weapon.

A drawback to existing multi-stage suppressors is that the blast suppressor chambers generally experience substantially greater radial pressures and temperatures than the succession of baffled expansion chambers. The difference in pressure and temperature does not ordinarily present a problem during intermittent firing of a weapon, wherein sufficient time passes between rounds to allow the pressure and temperature within the suppressor to abate. During a relatively high rate of fire, such as sustained fully automatic fire, the difference in pressure and temperature may cause the outer tubular housing of the suppressor to fail prematurely. In some instances, the outer tubular housing may "blow out" due to sustained local pressures and temperatures during fully automatic firing of the weapon.

Still another problem with existing suppressors pertains to their ability to effectively suppress muzzle flash. Many existing suppressors are known to exhibit a relatively large muzzle flash when a first round is fired through the suppressor, such as when the weapon has not been recently fired. Immediately subsequent rounds, however, typically do not exhibit this relatively large muzzle flash.

Still another problem with existing suppressors pertains to their ability to effectively suppress muzzle flash at high temperatures. Many existing suppressors with good first and steady state flash performance are known to exhibit a large, intermittent muzzle flash when the suppressor reaches a threshold temperature due to successive firings.

Given the above-mentioned drawbacks to existing suppressors, there is a continuous desire to develop firearm sound suppressors that exhibit relatively low back pressure while effectively suppressing sound and flash due to firing the weapon.

SUMMARY

An apparatus and methods are provided for a front plate having a diverging central bore for firearm sound suppressors that improves noise and flash characteristics during firing a weapon. The central bore is disposed between a back surface and a front surface of the front plate. An untapered portion of the central bore extends from the back surface to a diverging portion that opens toward the front surface. The diverging portion includes a curvature profile configured to allow for more controlled expansion of high-pressure propellant gases exiting of the suppressor through the central bore. The curvature profile provides an included angle of the central bore that decreases secondary flash events accompanying the expulsion of propellant gases accompanying a fired bullet exiting the suppressor through the central bore. The curvature profile exhibits a cross-sectional area of the central bore that is proportional to a distance along the diverging portion.

In an exemplary embodiment, a front plate for a suppressor for coupling with a muzzle end of a barrel of a firearm for reducing muzzle blast and eliminating muzzle flash comprises: a central bore disposed between a back surface and a front surface of the front plate; and an untapered portion of the central bore extending from the back surface to a diverging portion.

In another exemplary embodiment, a front-most portion of the central bore is substantially flush with the front surface of the front plate. In another exemplary embodiment, the diverging portion opens toward the front surface of the front plate and has an included angle. In another exemplary embodiment, the included angle ranges between approximately 10 degrees and approximately 25 degrees.

In another exemplary embodiment, at least one recess is disposed between an outer rim and the central bore of the front plate. In another exemplary embodiment, one or more scallops are disposed in the at least one recess and arranged around the central bore. In another exemplary embodiment, the diverging portion includes a contoured or parabolic shape configured to allow for a more controlled expansion of high-pressure propellant gases exiting of the suppressor through the central bore. In another exemplary embodiment, the contoured or parabolic shape is configured to reduce turbulent properties of the high-pressure propellant gases.

In another exemplary embodiment, the diverging portion includes a curvature profile comprising a straight line extending between a first point of the diverging portion and a second point of the diverging portion. In another exemplary embodiment, the curvature profile is configured to provide a cross-sectional area of the central bore that is directly proportional to a position along the curvature profile between the first point and the second point. In another exemplary embodiment, the curvature profile is configured to provide a cross-sectional area of the central bore that increases as a function of the distance from the first point. In another exemplary embodiment, the curvature profile comprises a curved segment that resembles a portion of a parabola. In another exemplary embodiment, the curvature profile is configured to provide an included angle of the central bore that decreases secondary flash events accompanying the expulsion of propellant gases accompanying a fired bullet exiting the suppressor by way of the central bore.

In an exemplary embodiment, a method for configuring a diverging central bore for a suppressor for coupling with a muzzle end of a barrel of a firearm for reducing muzzle blast and eliminating muzzle flash comprises: providing a diameter of an untapered portion of the diverging central bore; specifying a desired bore diameter at a distance along a diverging portion of the diverging central bore; computing a slope area curve by way of the desired bore diameter; determining a cross-sectional area of the diverging portion as a function of distance along the diverging portion; and configuring a curvature profile of the diverging portion.

In an exemplary embodiment, a suppressor for coupling with a muzzle end of a barrel of a firearm for reducing muzzle blast and eliminating muzzle flash comprises: a housing having a proximal end and a distal end; a front portion within the housing for attenuating the temperature and energy of propellant gases; an annular gas expansion chamber for directing a portion of the propellant gases to peripheral vents disposed at the distal end; a rear portion for deflecting and rebounding a portion of the propellant gases before entering the annular gas expansion chamber; and a front plate including a diverging central bore adapted to provide an exit to a projectile fired from the firearm.

In another exemplary embodiment, the diverging central bore includes a curvature profile comprising a straight line extending between a first point of the diverging central bore and a second point of the diverging central bore. In another exemplary embodiment, the curvature profile is configured to provide a cross-sectional area of the diverging central bore that is directly proportional to a position along the curvature profile between the first point and the second point. In another exemplary embodiment, the curvature profile is configured to provide a cross-sectional area of the diverging central bore that increases as a function of the distance from the first point. In another exemplary embodiment, the curvature profile comprises a curved segment that resembles a portion of a parabola. In another exemplary embodiment, the curvature profile is configured to provide an included angle of the diverging central bore that decreases secondary flash events accompanying the expulsion of propellant gases accompanying a fired bullet exiting the suppressor by way of the central bore.

In an exemplary embodiment, a front plate for a suppressor for coupling with a muzzle end of a barrel of a firearm for reducing muzzle blast and eliminating muzzle flash comprises: a central bore disposed between a back surface and a front surface of the front plate; a converging portion of the central bore extending from the back surface; and a diverging portion of the central bore opening toward the front surface.

In another exemplary embodiment, the converging portion meets the diverging portion within an interior of the central bore. In another exemplary embodiment, the converging portion comprises a smooth surface beginning at a start angle with respect to the back surface. In another exemplary embodiment, the converging portion meets the diverging portion at a location within the central bore having a tangent angle with respect to a longitudinal axis of the central bore. In another exemplary embodiment, the tangent angle comprises an end angle of the converging portion and comprises a start angle of the diverging portion. In another exemplary embodiment, the converging portion smoothly blends with the diverging portion so as to maintain an attachment of the propellant gasses to walls of the central bore along the length of the central bore.

In another exemplary embodiment, the converging portion blends joins the diverging portion with a non-tangent blend, such that the expansion of the supersonic gasses is controlled. In another exemplary embodiment, the converging portion and the diverging portion are discontinuous, such that control of the expansion of the supersonic gasses is controlled. In another exemplary embodiment, the converging portion and the diverging portion comprise a combination of multiple straight and/or curved profiles, such that the resulting profile is functionally equivalent to embodiments wherein the end angle of the converging portion comprises the start angle of the diverging portion. In another exemplary embodiment, the converging portion smoothly blends with the diverging portion so as to maintain an attachment of the propellant gasses to walls of the central bore along the length of the central bore. In another exemplary embodiment, the performance of the front plate may be tuned to certain ambient conditions by manipulating the geometry of any one or more of the converging portion, the diverging portion, the start angle, the end angle, and the overall length of the central bore.

In another exemplary embodiment, the converging portion extends from a backmost surface of the front plate and meets the diverging portion within an interior of the central bore. In another exemplary embodiment, the converging portion extends from a point inset from a backmost surface of the front plate and meets the diverging portion within an interior of the central bore. In another exemplary embodiment, the converging portion comprises a straight bore. In another exemplary embodiment, the backmost surface is disposed proximal of the back surface by an offset distance. In another exemplary embodiment, the offset distance gives the central bore an overall nozzle length that is greater than the distance between the back surface and the front surface of the front plate. In another exemplary embodiment, the converging portion comprises a throat area of the central bore at the backmost surface.

In another exemplary embodiment, the diverging portion comprises an exit area of the central bore at the front surface. In another exemplary embodiment, desirable expansion, speed, and/or turbulence properties of the propellant gases transiting the central bore can be obtained by manipulating any one or more of the throat area, the exit area, a ratio of throat area to exit area, the offset distance, the overall nozzle length, or any combination thereof. In another exemplary embodiment, the throat area and the exit area may be configured to produce a desired ratio between a mass flux of the propellant gases transiting the central bore and the mass flux of the propellant gases exiting an annular exit area comprising peripheral vents surrounding the front plate. In another exemplary embodiment, the throat area and the exit area are configured to produce a desired ratio between a mass flux of the propellant gases transiting the central bore and the mass flux of the propellant gases exiting an annular exit area comprising a plurality of peripheral vents surrounding the central bore.

In an exemplary embodiment, a suppressor for coupling with a muzzle end of a barrel of a firearm for reducing muzzle blast and eliminating muzzle flash comprises: a housing having a proximal end and a distal end; a front portion within the housing for attenuating the temperature and energy of propellant gases; an annular gas expansion chamber for directing a first portion of the propellant gases to peripheral vents disposed at the distal end; and a central bore for directing a second portion of the propellant gases out of the front portion.

In another exemplary embodiment, the central bore is configured to produce a desirable ratio between a mass flux of the first portion and the mass flux of the second portion. In another exemplary embodiment, the central bore is configured to produce a desirable ratio between a gas speed of the first portion and the gas speed of the second portion. In another exemplary embodiment, the central bore is configured to produce a desirable interaction between gas flow of the first portion and gas flow of the second portion. In another exemplary embodiment, the central bore includes a converging portion that smoothly blends with a diverging portion that opens to a front of the front portion. In another exemplary embodiment, the converging portion and the diverging portion are configured to maintain an attachment of the propellant gasses to interior walls of the central bore along a length of the central bore.

In another exemplary embodiment, the converging portion blends joins the diverging portion with a non-tangent blend, such that the expansion of the supersonic gasses is controlled. In another exemplary embodiment, the converging portion and the diverging portion are discontinuous, such that control of the expansion of the supersonic gasses is controlled. In another exemplary embodiment, the converging portion and the diverging portion comprise a combination of multiple straight and/or curved profiles, such that the resulting profile is functionally equivalent to embodiments wherein the end angle of the converging portion comprises the start angle of the diverging portion. In another exemplary embodiment, the converging portion smoothly blends with the diverging portion so as to maintain an attachment of the propellant gasses to walls of the central bore along the length of the central bore. In another exemplary embodiment, the converging portion extends from a point inset from a backmost surface of the front plate and meets the diverging portion within an interior of the central bore. In another exemplary embodiment, the converging portion comprises a straight bore.

In another exemplary embodiment, performance of the front plate may be tuned to certain ambient conditions by manipulating the geometry of either or both of the converging portion and the diverging portion. In another exemplary embodiment, expansion, speed, and/or turbulence properties of the propellant gases can be optimized by manipulating any one or more of a throat area of the converging portion, an exit area of the diverging area, a ratio of the throat area to the exit area, an offset distance between the throat area and a back surface of the front plate, an overall nozzle length of the central bore, or any combination thereof.

These and other features of the concepts provided herein may be better understood with reference to the drawings, description, and appended claims.

BRIEF DESCRIPTION OF THE DRAWINGS

The drawings refer to embodiments of the present disclosure in which:

FIG. 3 illustrates a perspective view of an exemplary embodiment of a front plate having a diverging central bore that may be incorporated into a suppressor;

FIG. 4 illustrates a cross-sectional view of the front plate of FIG. 3, taken along line 4-4 of FIG. 3;

FIG. 8A illustrates a table of computations that provides an exemplary embodiment of a curvature profile that may be computed by way of a desired bore diameter specified at a first distance along a diverging central bore;

FIG. 8B illustrates a table of computations that provides an exemplary embodiment of a curvature profile that may be computed by way of a desired bore diameter specified at a second distance along the diverging central bore;

FIG. 8C illustrates a table of computations that provides an exemplary embodiment of a curvature profile that may be computed by way of a desired bore diameter specified at a third distance along the diverging central bore;

Figure 1:
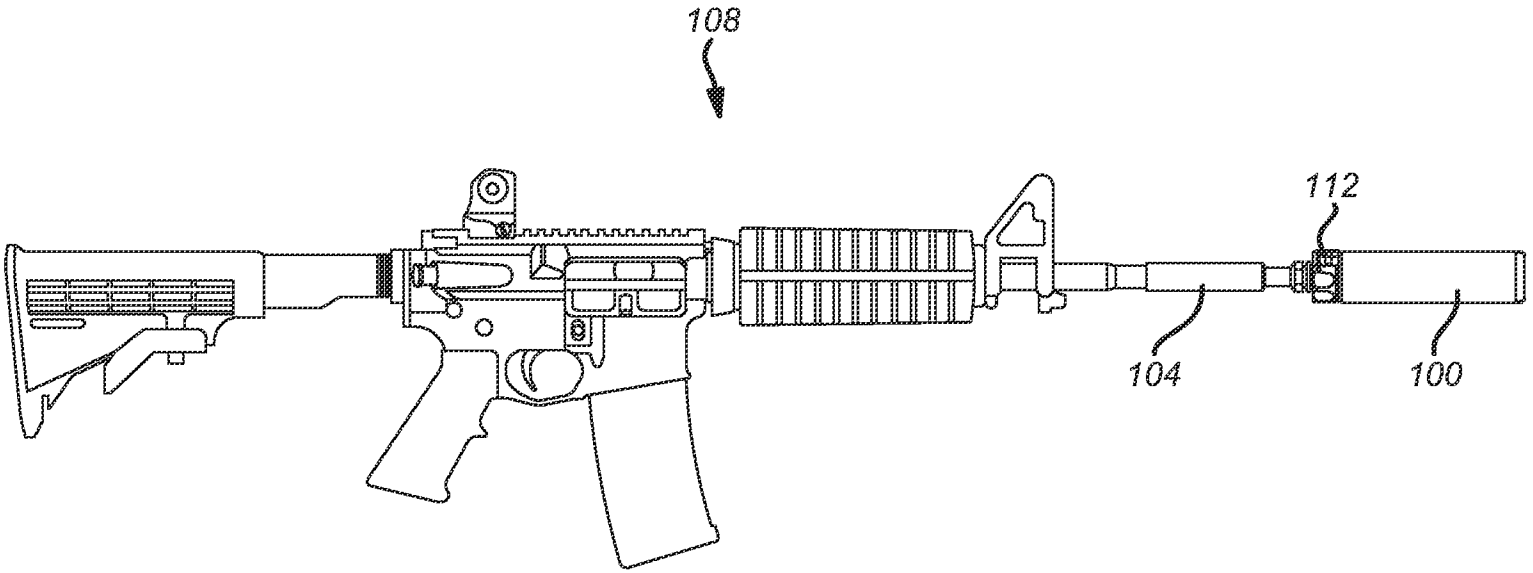
FIG. 1 illustrates a right-side elevation view of an exemplary embodiment of a suppressor coupled to a muzzle end of a barrel of a rifle in accordance with the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the diverging central bore and methods disclosed herein may be practiced without these specific details. In other instances, specific numeric references such as "first chamber," may be made. However, the specific numeric reference should not be interpreted as a literal sequential order but rather interpreted that the "first chamber" is different than a "second chamber." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, muzzle blasts of firearms may be reduced by using sound suppressors, such as "noise suppressors" and "silencers." Existing suppressors have certain drawbacks that generally hinder their operation and/or efficiency. One drawback to existing suppressors is that many existing suppressors exhibit a relatively large muzzle flash when a first round is fired through the suppressor, such as when the weapon has not been recently fired, while subsequent rounds typically do not exhibit this relatively large muzzle flash. Embodiments presented herein provide a diverging central bore to be implemented in suppressors to effectively minimize muzzle flash and muzzle blast.

FIG. 1 illustrates a right-side elevation view of an exemplary embodiment of a suppressor 100 that is suited for implementation of a diverging central bore and is coupled to the muzzle end of a barrel 104 of a firearm 108, such as a rifle, in accordance with the present disclosure. In the illustrated embodiment, the suppressor 100 is coupled with the barrel 104 by way of a retaining mechanism 112. For example, such a retaining mechanism may be implemented as described in U.S. Pat. Nos. 6,948,415, 7,676,976, 7,946,069, 8,091,462, and 8,459,406, all of which are incorporated by reference herein in their entirety. It is contemplated, however, that the suppressor 100 may be attached to the barrel 104 by way of any of various suitable devices and/or techniques.

Figure 2:
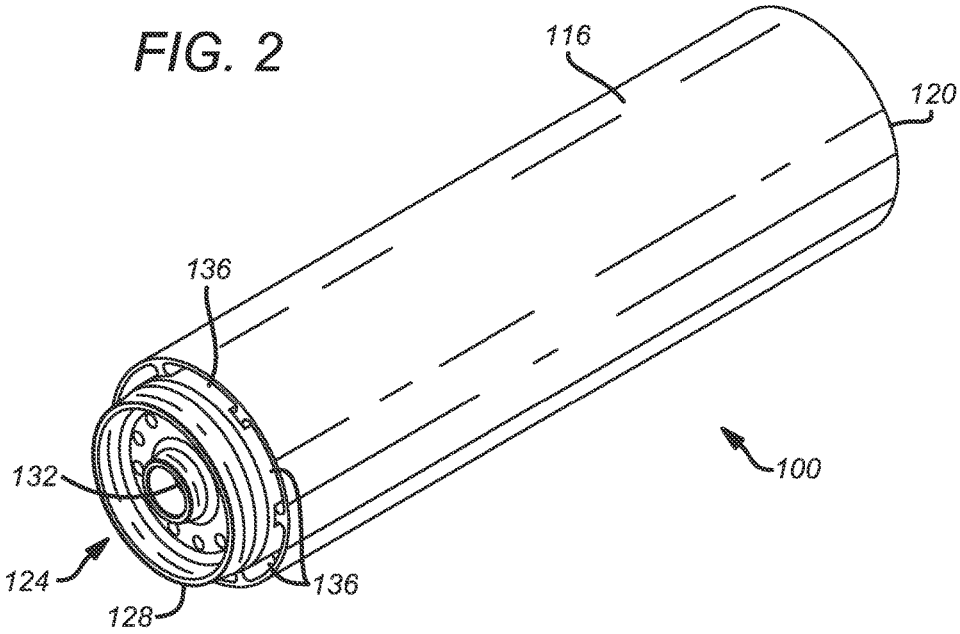
FIG. 2 illustrates a perspective view of an exemplary embodiment of a suppressor that may be coupled to the muzzle end of a barrel of a firearm.

FIG. 2 illustrates a perspective view of an exemplary embodiment of a suppressor 100 that may be coupled to the muzzle end of a barrel 104 of a firearm 108, as shown in FIG. 1. The suppressor 100 is a generally elongate member comprising a housing 116 and having a proximal end 120 and a distal end 124. The proximal end 120 is adapted to couple the suppressor 100 to the muzzle end of the barrel 104, such as by way of the above-mentioned retaining mechanism 112 or other suitable device. The distal end 124 comprises a front plate 128, a central bore 132, and a series of peripheral vents 136 disposed between the front plate 128 and the housing 116. In some embodiments, the peripheral vents 136 may be arranged to vent propellant gases in a distal direction or radially outward around the circumference of the housing 116, without limitation. The central bore 132 is adapted to provide an exit to a projectile, or a bullet, fired from the firearm 108 while the peripheral vents 136 are configured to provide an exit to expanding propellant gases accompanying the firing of the projectile.

The suppressor 100 illustrated in FIG. 2 generally is of a "multi-stage" variety that is configured to divert a portion of propellant gases through a plurality of lateral blast suppression chambers before mixing the gases with a portion of propellant gases introduced into a succession of expansion chambers, as disclosed in greater detail in U.S. patent application, entitled "Firearm Sound Suppressor With Peripheral Venting," filed on Feb. 25, 2022, and having application Ser. No. 17/681,246, which claims the benefit of and priority to U.S. Provisional Application, filed on Feb. 26, 2021 and having application Ser. No. 63/154,564, the entirety of both of said applications being incorporated herein by reference. It is contemplated that, in some embodiments, the suppressor 100 may comprise a multiplicity of components that may be assembled, such as by way of laser welding as detailed in U.S. Pat. No. 10,088,259, which is incorporated herein by reference in its entirety. In some embodiments, however, the suppressor 100 may be monolithic in nature, and thus the suppressor 100 may be formed by way of 3D printing or other similar techniques, without limitation.

As described in detail in U.S. Pat. No. 8,505,680, which is incorporated herein by reference in its entirety, it is common for a first round fired from a "cold" conventional suppressor (e.g., a suppressor that has not been recently fired) to exhibit a relatively large muzzle flash, while immediately succeeding rounds fired through the same suppressor typically do not exhibit as large a flash as that exhibited by the first round.

Experimental observation has demonstrated that this transient phenomenon results from circumstances where a suppressor through which a round has not recently been fired is relatively "cool" and is filled with oxygen-rich ambient air. As such, the cold suppressor may be substantially at thermal equilibrium with its surrounding environment and its interior lumens and chambers may be substantially filled with ambient air rather than combustion gases. When an initial round is then fired through the suppressor, the oxygen content of the gas within the suppressor is sufficient to sustain additional combustion of the oxygen within the suppressor, giving rise to a relatively large flash at an outlet end thereof. When subsequent rounds are fired through the suppressor, however, the oxygen content of the gas in the suppressor is relatively depleted due to the interior lumens and chambers having become substantially filled with combustion gases. Thus, additional combustion of oxygen within the suppressor is no longer sustainable, and relatively smaller muzzle flashes are produced.

Experimental observation has further shown that the heightened first-round muzzle flash phenomenon discussed above can be substantially reduced or eliminated altogether by providing a suppressor, such as the suppressor 100, with a front plate 128 having a central bore 132 (e.g., a frustoconical bore in one embodiment) extending therethrough and including a taper. The taper has been observed to reduce the size of the first-round muzzle flash by permitting additional ambient air to escape from within the suppressor 100 prior to combustion of the associated oxygen. It is contemplated that the ambient air escaping the central bore 132 distributes the first-round muzzle flash and at least some associated gases over a broader area, thus reducing the length of the first-round muzzle flash. Such an implementation can reduce the size and/or length of the first-round muzzle flash and is particularly useful to reduce the detection (e.g., visual, thermal, and/or infrared imaging) of automatic weapons fired from hidden or obscured locations.

FIGS. 3-4 illustrate an exemplary embodiment of a front plate 128 and a central bore 132 that may be incorporated into the distal end 124 of the suppressor 100 (see FIG. 2). As shown the cross-sectional view of FIG. 4, the central bore 132 may be implemented with a tapered portion 140 and an untapered portion 144. The untapered portion 144 extends from a back surface 148 of the front plate 128 to meet the tapered portion 140 within an interior of the central bore 132. The tapered portion 140 opens toward a front surface 152 of the front plate 128 and has an included angle 156. In some embodiments, the included angle 156 may range between approximately 10 degrees and approximately 25 degrees. In one embodiment, included angle 156 is approximately 20 degrees. Other embodiments are also contemplated. For example, the untapered portion 144 may be implemented with different lengths and/or omitted altogether. For example, in one embodiment the tapered portion 140 may extend entirely from the back surface 148 to the front surface 152 of the front plate 128.

As further shown in FIGS. 3-4, any of various scallops and recesses may be provided in the front plate 128 to reduce weight. For example, a recess 160 may be disposed between an outer rim or lip of the front plate 128 and a central portion of the front plate 128 providing the central bore 132. As best shown in FIG. 3, scallops 164 can be disposed in the recess 160 and arranged around the central bore 132 to enhance the aesthetic appeal of the front plate 128. Further, in the particular example embodiment illustrated in FIGS. 3-4, the front-most portion of the central bore 132 is substantially flush with the front surface 152 of the front plate 128, but other configurations are also contemplated.

Figure 5:
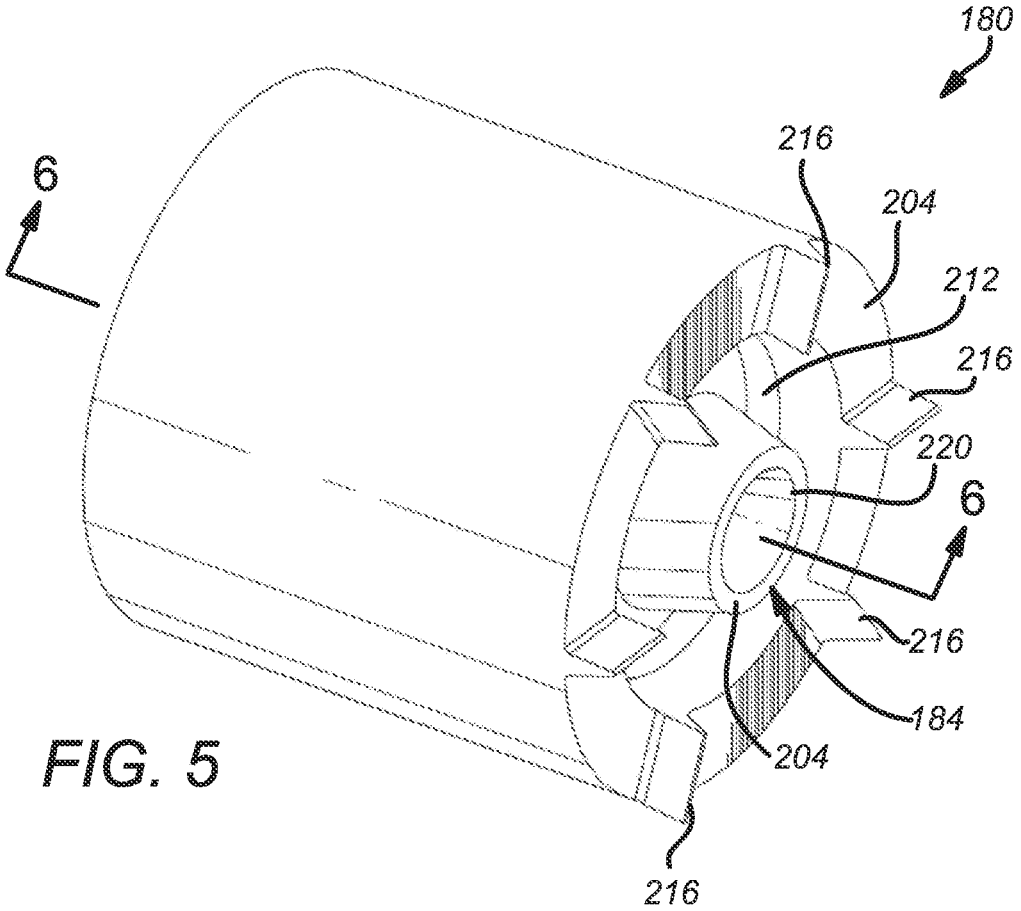
FIG. 5 illustrates a perspective view of an exemplary embodiment of a front plate having a diverging central bore that may be incorporated into a suppressor.
Figure 6:
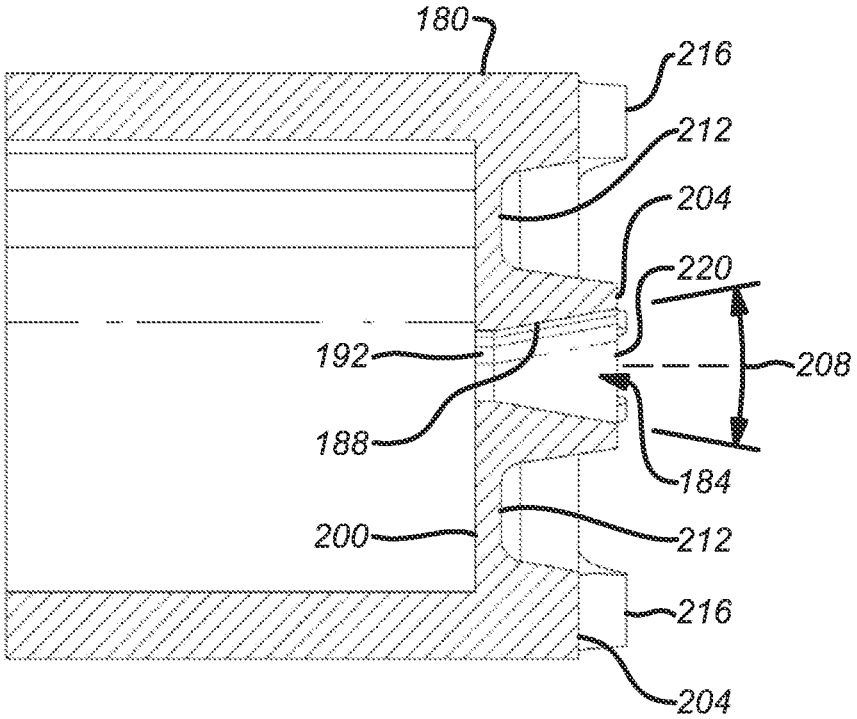
FIG. 6 illustrates a cross-sectional view of the front plate of FIG. 5, taken along line 6-6 of FIG. 5.

FIGS. 5-6 illustrate an exemplary embodiment of a front plate 180 and a central bore 184 that may be incorporated into the distal end 124 of the suppressor 100 (see FIG. 2). As shown the cross-sectional view of FIG. 6, the central bore 184 may be implemented with a tapered portion 188 and an untapered portion 192. The untapered portion 192 extends from a back surface 200 of the front plate 180 to meet the tapered portion 188 within an interior of the central bore 184. The tapered portion 188 opens toward a front surface 204 of the front plate 180 and has an included angle 208. In some embodiments, the included angle 208 may range between approximately 10 degrees and approximately 25 degrees. In one embodiment, the included angle 208 is approximately 20 degrees. Other embodiments are also contemplated. For example, the untapered portion 192 may be implemented with different lengths and/or omitted altogether. For example, in one embodiment the tapered portion 188 may extend entirely from the back surface 200 to the front surface 204 of the front plate 180.

It is contemplated that any of various scallops and recesses may be provided in the front plate 180 to reduce weight. For example, a recess 212 may be disposed between an outer rim or lip of the front plate 180 and a central portion of the front plate 180 providing the central bore 184. As will be appreciated, scallops (not shown) can be disposed in the recess 212 and arranged around the central bore 184 to enhance the aesthetic appeal of the front plate 180 as well as to reduce weight. Further, in the particular example embodiment illustrated in FIGS. 5-6, the front plate 180 may also include a series of elevations 216 extending outward from the front surface 204 of the front plate 180.

As described herein, the tapered portion 188 of the central bore 184 has been observed to reduce the size of the first-round muzzle flash by permitting additional ambient air to escape from within the suppressor 100 prior to combustion of the associated oxygen. It is contemplated that the ambient air escaping the central bore 184 distributes the first-round muzzle flash and at least some associated gases over a broader area, thus reducing the length of the first-round muzzle flash. Such an implementation can reduce the size and/or length of the first-round muzzle flash and is particularly useful to reduce the detection (e.g., visual, thermal, and/or infrared imaging) of automatic weapons fired from hidden or obscured locations.

Moreover, it is contemplated that the tapered portion 188 has at least a contoured or parabolic shape that may allow for a more controlled expansion of high-pressure propellant gases that leave the distal end 124 of the suppressor 100 through the central bore 184. Additionally, the contoured or parabolic shape of the tapered portion 188 may reduce the strength of the oblique shock train originating at the central bore exit 220 and improve flash characteristics. Further, the contoured or parabolic shape of the tapered portion 188 contributes to turning the edges of the high-pressure propellant expelled gases parallel with the direction of primary flow, which will greatly decrease larger turbulent structures at the boundaries of the suppressor 100. The decrease in turbulent properties exiting the central bore 184 enables decreasing secondary flash events that accompany the expulsion of propellant gases accompanying a fired bullet exiting the suppressor by way of the central bore 184.

Figure 7:
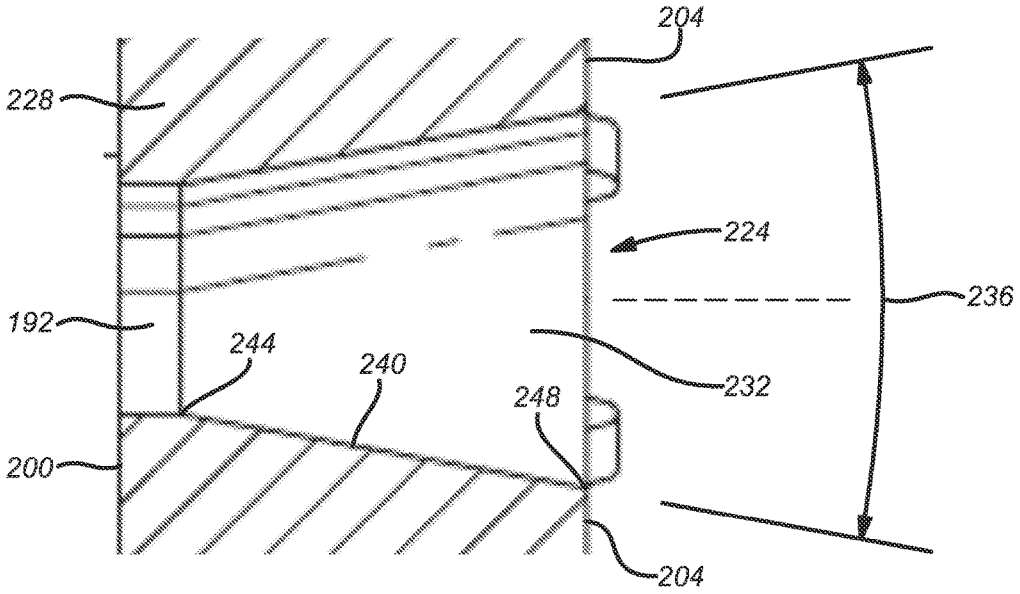
FIG. 7 illustrates a cross-sectional view of an upper half of an exemplary embodiment of a diverging central bore that may be incorporated into a front plate of a suppressor, according to the present disclosure.

FIG. 7 illustrates a cross-sectional view of an upper half of an exemplary embodiment of a central bore 224 that may be incorporated into a front plate 228 of a suppressor, such as the suppressor 100 shown in FIG. 2. In the embodiment of FIG. 7, the central bore 224 is implemented with a diverging portion 232 and an untapered portion 192. The untapered portion 192 extends from a back surface 200 of the front plate 228 to meet the diverging portion 232 within an interior of the central bore 224. The diverging portion 232 opens toward a front surface 204 of the front plate 228 and has an included angle 236. In some embodiments, the included angle 236 may range between approximately 10 degrees and approximately 25 degrees. In one embodiment, the included angle 236 is approximately 14 degrees. In another embodiment, the included angle 236 is about 20 degrees. Other embodiments are also contemplated. For example, the untapered portion 192 may be implemented with different lengths and/or omitted altogether. Further, in some embodiments, the diverging portion 232 may extend entirely from the back surface 200 to the front surface 204 of the front plate 228.

Moreover, the degree of taper comprising the diverging portion 232 may be varied to optimize the decrease in turbulent properties exiting the central bore 224. For example, in the embodiment shown in FIG. 7, a curvature profile 240 of the sidewall of the diverging portion 232 may be defined as a straight line extending between a first point 244 and a second point 248. As will be appreciated, a straight-line curvature profile 240 gives rise to a cross-sectional area of the central bore 224 that is directly proportional to the position along the curvature profile 240 between the first and second points 244, 248. As described hereinabove, such a uniform diverging portion 232 has been observed to reduce the size of the first-round muzzle flash by permitting additional ambient air to escape from within the suppressor 100 prior to combustion of the associated oxygen.

In some embodiments, however, the curvature profile 240 may comprise a curved segment, such as a portion of a parabola, or other suitable function, without limitation. For example, in one embodiment, the curvature profile 240 may be configured such that the cross-sectional area of the central bore 224 increases in direct proportion to the square of the distance from the first point 244. In another embodiment, the curvature profile 240 may be configured such that the cross-sectional area of the central bore 224 increases as a function of the cube of the distance from the first point 244. Other functions are contemplated, without limitation. Further, the curvature profile 240 may be configured to produce any of various included angles 236 as are found to be beneficial for decreasing secondary flash events accompanying the expulsion of propellant gases accompanying a fired bullet exiting the suppressor 100 by way of the central bore 224.

FIGS. 8A-8C illustrate tables of computations that provide exemplary embodiments of a curvature profile 240 that may be incorporated into a central bore 224 having a diverging portion 232 that is 0.32 inches in length and an untapered portion 192 that is 0.28 inches in diameter. In each of the illustrated exemplary embodiments, an Area Equation 260 is used to determine the cross-sectional area of the diverging portion 232 as a function of distance along the diverging portion 232 from the untapered portion 192.

As will be recognized by those skilled in the art, the Area Equation 260 is a linear expression having a slope comprising a Slope Area Curve 264. The Slope Area Curve 264 is computed by way of a desired bore diameter 268 that may be specified for a particular distance along the diverging portion 232. For example, in the exemplary embodiment of FIG. 8A, the bore diameter 268 is specified for a distance of 1/10 (e.g., 10%) of the length of the diverging portion 232 or about 0.032 inches from the untapered portion 192. As shown in FIG. 8B, the bore diameter 268 is specified for a distance of ¼ (e.g., 25%) of the length of the diverging portion 232 or about 0.080 inches from the untapered portion 192. Similarly, the bore diameter 268 of FIG. 8C is specified for a distance of 9/10 (e.g., 90%) of the length of the diverging portion 232 or about 0.288 inches from the untapered portion 192.

Once the Slope Area Curve 264 is determined, the Area Equation 260 may be used to compute a series of cross-sectional area values 272 and corresponding diameter values 276 based on a series of distance values 280 along the diverging portion 232. As will be appreciated, the variation in the cross-sectional area values 272 and diameter values 276, taken as a function of distance, dictate the specific configuration of the curvature profile 240 along the diverging portion 232 as well as the value of the included angle 236. As such, each of the tables shown in FIGS. 8A-8C illustrates an exemplary embodiment of the diverging portion 232 comprising a unique curvature profile 240 and included angle 236, as shown in FIG. 7. It should be borne in mind, therefore, that the curvature profile 240 and the included angle 236 may be derived, as well as altered, without limitation, and without deviating beyond the spirit and scope of the present disclosure.

Figure 9A:
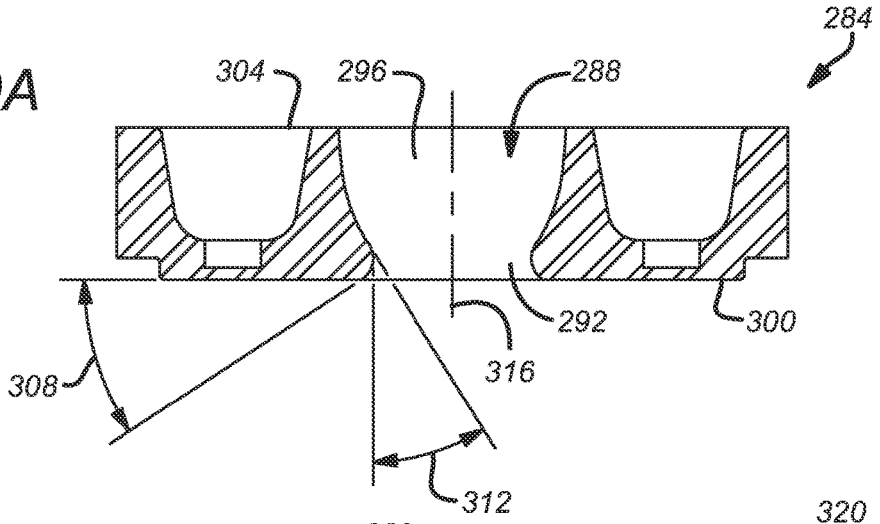
FIG. 9A illustrates a cross-sectional view of an exemplary embodiment of a front plate comprising a central bore having start angles and end angles that define a converging portion and a diverging portion.

FIG. 9A illustrates a cross-sectional view of an exemplary embodiment of a front plate 284 comprising a central bore 288 that may be incorporated into a suppressor, such as the suppressor 100 shown in FIG. 2. In the embodiment of FIG. 9A, the central bore 288 is implemented with a converging portion 292 and a diverging portion 296. The converging portion 292 extends from a back surface 300 of the front plate 284 to meet the diverging portion 296 within an interior of the central bore 288. The diverging portion 296 opens toward a front surface 304 of the front plate 284.

In the illustrated embodiment of FIG. 9A, the converging portion 292 comprises a smooth surface beginning at a start angle 308 with respect to the back surface 300. As shown in FIG. 9A, the converging portion 292 meets the diverging portion 296 at a location within the central bore 288 having a tangent angle with respect to a longitudinal axis 316 of the central bore 288. As such, the tangent angle comprises an end angle 312 of the converging portion 292 while also comprising a start angle of the diverging portion 296. It has been observed that smoothly blending the converging portion 292 and the diverging portion 296 maintains an attachment of supersonic gasses to the walls of the central bore 288 along the length of the central bore 288. It is contemplated, therefore, that the performance of the front plate 284 may be advantageously tuned to certain ambient conditions by manipulating the geometry of any one or more of the converging and diverging portions 292, 296, the start and end angles 308, 312, as well as the overall length of the central bore 288, without limitation.

In some embodiments, the converging portion 292 blends joins the diverging portion 296 with a non-tangent blend, such that the expansion of the supersonic gasses is controlled. In some embodiments, the converging and diverging portions 292, 296 are discontinuous, such that control of the expansion of the supersonic gasses is still controlled. Further, in some embodiments, the converging and diverging portions 292, 296 may comprise an advantageous combination of multiple straight and/or curved profiles, such that the resulting profile is functionally equivalent to embodiments wherein the end angle 312 of the converging portion 292 comprises the start angle of the diverging portion 296.

Figure 9B:
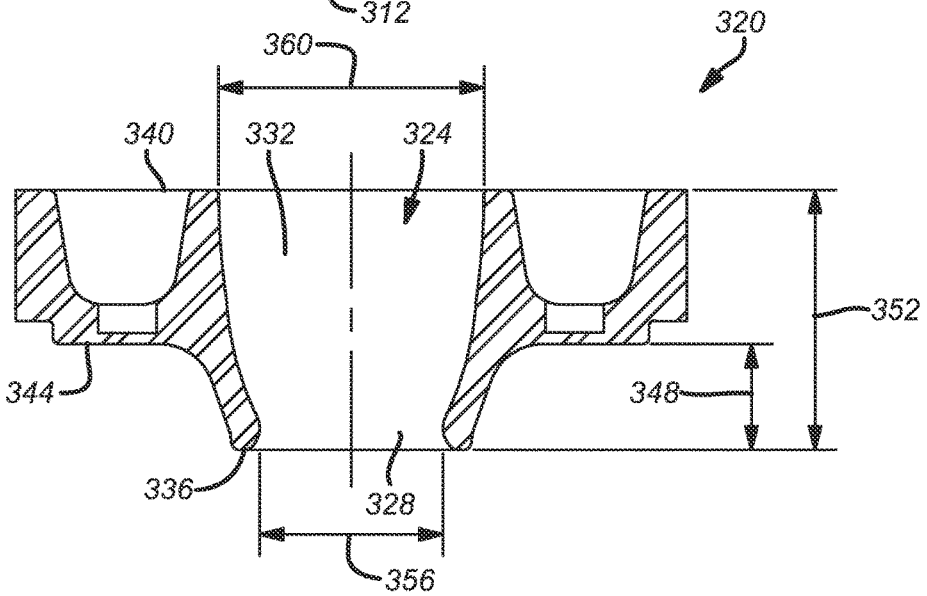
FIG. 9B illustrates a cross-sectional view of an exemplary embodiment of a front plate comprising a central bore that includes a backwards extension into a body of a host suppressor.

FIG. 9B illustrates a cross-sectional view of an exemplary embodiment of a front plate 320 comprising a central bore 324 that may be incorporated into a suppressor, such as the suppressor 100 shown in FIG. 2. The central bore 324 shown in FIG. 9B is implemented with a converging portion 328 and a diverging portion 332. The converging portion 328 extends from a backmost surface 336 of the front plate 320 to meet the diverging portion 332 within an interior of the central bore 324. In some embodiments, however, the converging portion 328 extends from a point inset from the backmost surface 336 of the front plate 320 and meets the diverging portion 332 within an interior of the central bore 324. Further, in some embodiments, the converging portion 328 may be absent or comprise a straight bore, without limitation. As shown in FIG. 9B, the diverging portion 332 opens toward a front surface 340 of the front plate 320. Further, in the embodiment of FIG. 9B, the backmost surface 336 is disposed proximal of a rear surface 344 of the front plate 320 by an offset distance 348. The offset distance 348 gives the central bore 324 an overall nozzle length 352 that is greater than the length of the central bore 288 shown in FIG. 9A.

As further shown in FIG. 9B, the converging portion 328 comprises a throat area 356 of the central bore 324 at the backmost surface 336. At the front surface 340, the diverging portion 332 comprises an exit area 360 of the central bore 324. It has been demonstrated that manipulating any one or more of the throat area 356, the exit area 360, a throat to exit area ratio, the offset distance 348, the overall nozzle length 352, or any combination thereof, give rise to desirable expansion, speed, and/or turbulence properties of propellant gases transiting the central bore 324. Further, it is contemplated that any one or more of the throat area 356, the exit area 360, the throat to exit area ratio, the offset distance 348, the overall nozzle length 352, or any combination thereof, may be configured to provide advantageous expansion states of the propellant gases transiting the central bore 324, such that the propellant gases are neither excessively under-expanded, leading to turbulent mixing with the ambient environment, nor excessively over-expanded, leading to plume collapse and Mach nodes or diamonds.

Figure 9C:
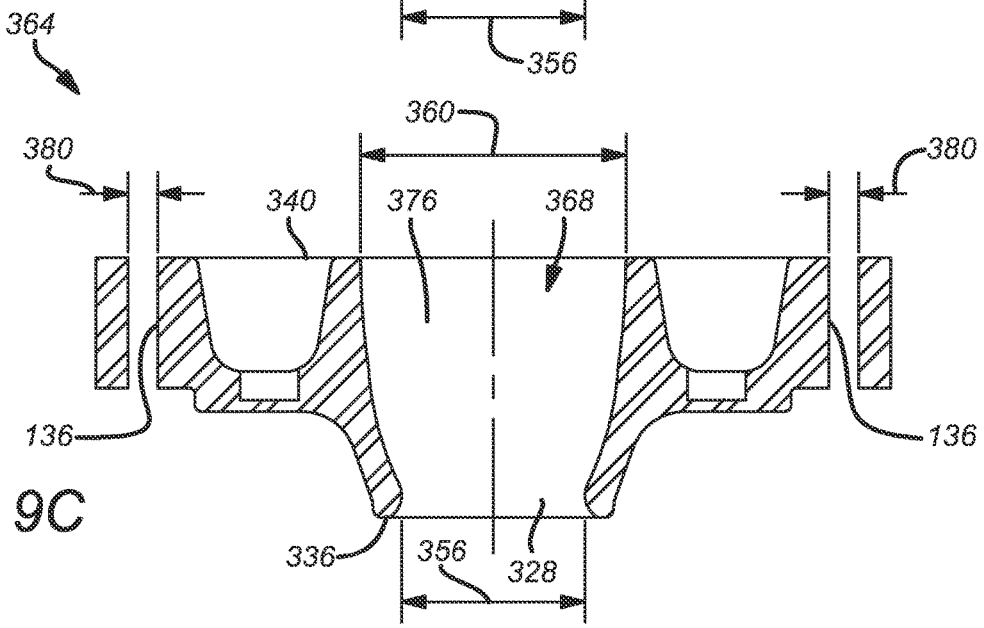
FIG. 9C illustrates a cross-sectional view of an exemplary embodiment of a front plate comprising a central bore having a nozzle length and exit and throat areas configured to impart desirable properties to gases traversing the nozzle.

FIG. 9C illustrates a cross-sectional view of an exemplary embodiment of a front plate 364 comprising a central bore 368 that may be incorporated into a suppressor, such as the suppressor 100 shown in FIG. 2. The front plate 364 shown in FIG. 9C is similar to the front plate 320 shown in FIG. 9B, with the exception that the front plate 364 of FIG. 9C includes peripheral vents 136, as best shown in FIG. 3. Similar to the central bore 324, described in connection with FIG. 9B, the central bore 368 includes a converging portion 372 that smoothly meets a diverging portion 376 within the central bore 368. The converging portion 372 comprises a throat area 356 of the central bore 368 at a backmost surface 336 of the front plate 364 while the diverging portion 376 comprises an exit area 360 of the central bore 368 at a front surface 340 of the front plate 364. Further, the peripheral vents 136 comprise an annular exit area 380 at the front surface 340 of the front plate 364. Experimentation has demonstrated that the throat and exit areas 356, 360 may be configured to produce an advantageous ratio between a mass flux of propellant gases transiting the central bore 368 and the mass flux of propellant gases exiting the annular exit area 380 of the peripheral vents 136. In some embodiments, the throat area 356 and the exit area 360 may be configured to produce a desired ratio between a mass flux of the propellant gases transiting the central bore 368 and the mass flux of the propellant gases exiting an annular exit area 380 comprising a plurality of peripheral vents 136 surrounding the central bore 368.

While the diverging central bore and methods have been described in terms of particular variations and illustrative figures, those of ordinary skill in the art will recognize that the diverging central bore is not limited to the variations or figures described. In addition, where methods and steps described above indicate certain events occurring in certain order, those of ordinary skill in the art will recognize that the ordering of certain steps may be modified and that such modifications are in accordance with the variations of the diverging central bore. Additionally, certain of the steps may be performed concurrently in a parallel process when possible, as well as performed sequentially as described above. To the extent there are variations of the diverging central bore, which are within the spirit of the disclosure or equivalent to the diverging central bore found in the claims, it is the intent that this patent will cover those variations as well. Therefore, the present disclosure is to be understood as not limited by the specific embodiments described herein, but only by scope of the appended claims.

What is claimed is:

1. A front plate for a suppressor for coupling with a muzzle end of a barrel of a firearm for reducing muzzle blast and eliminating muzzle flash, the front plate comprising:
   - a central bore disposed between a back surface and a front surface of the front plate;
   - a converging portion of the central bore extending from the back surface wherein the converging portion extends from a backmost surface of the front plate and meets a diverging portion within an interior of the central bore wherein the backmost surface is disposed proximal of the back surface by an offset distance; and
   - the diverging portion of the central bore opening toward the front surface wherein the front surface encloses the central bore;
   - a recess disposed away from the central bore and between an outer lip and the central bore.

2. The front plate of claim 1, wherein the offset distance gives the central bore an overall nozzle length that is greater than the distance between the back surface and the front surface of the front plate.

3. The front plate of claim 1, wherein the converging portion comprises a throat area of the central bore at the backmost surface.

4. The front plate of claim 1, wherein the diverging portion comprises an exit area of the central bore at the front surface.

5. The front plate of claim 4, wherein desirable expansion, speed, and/or turbulence properties of the propellant gases transiting the central bore can be obtained by manipulating any one or more of the throat area, the exit area, a ratio of throat area to exit area, the offset distance, the overall nozzle length, or any combination thereof.

6. The front plate of claim 4, wherein the throat area and the exit area are configured to produce a desired ratio between a mass flux of the propellant gases transiting the central bore and the mass flux of the propellant gases exiting an annular exit area comprising peripheral vents surrounding the front plate.

7. The front plate of claim 4, wherein the throat area and the exit area are configured to produce a desired ratio between a mass flux of the propellant gases transiting the central bore and the mass flux of the propellant gases exiting an annular exit area comprising a plurality of peripheral vents surrounding the central bore.

* * * * *